US008607546B2

(12) United States Patent
Sun

(10) Patent No.: US 8,607,546 B2
(45) Date of Patent: Dec. 17, 2013

(54) METHOD FOR MONITORING HYDROCARBON SLIP FROM AN OXIDATION CATALYST

(75) Inventor: Min Sun, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 302 days.

(21) Appl. No.: 13/105,054

(22) Filed: May 11, 2011

(65) Prior Publication Data

US 2012/0285140 A1 Nov. 15, 2012

(51) Int. Cl.
*F01N 3/00* (2006.01)

(52) U.S. Cl.
USPC ..... 60/286; 60/274; 60/285; 60/299; 60/303

(58) Field of Classification Search
USPC ..... 60/274, 278, 286, 295, 297, 299, 303, 60/311
See application file for complete search history.

(56) References Cited

U.S. PATENT DOCUMENTS

| | | | | |
|---|---|---|---|---|
| 6,983,589 | B2 * | 1/2006 | Lewis et al. | 60/277 |
| 7,942,043 | B2 * | 5/2011 | Liu et al. | 73/114.75 |
| 8,020,375 | B2 * | 9/2011 | Oba et al. | 60/286 |
| 8,240,133 | B2 * | 8/2012 | Jasinkiewicz et al. | 60/286 |
| 8,266,896 | B2 * | 9/2012 | Morishima et al. | 60/287 |
| 2007/0163242 | A1 * | 7/2007 | Matsuoka et al. | 60/286 |

* cited by examiner

*Primary Examiner* — Binh Q Tran

(57) ABSTRACT

A method for operating a compression-ignition internal combustion engine including an exhaust aftertreatment system having an oxidation catalyst fluidly coupled upstream of a catalyzed particulate filter includes introducing fuel into an exhaust gas feedstream of the engine upstream of the oxidation catalyst, determining operating parameters associated with the exhaust gas feedstream, determining a hydrocarbon slip rate through the oxidation catalyst corresponding to the operating parameters associated with the exhaust gas feedstream and the introduced fuel into the exhaust gas feedstream, and controlling a flowrate of fuel introduced into the exhaust gas feedstream upstream of the oxidation catalyst in response to the estimated hydrocarbon slip rate through the oxidation catalyst.

11 Claims, 3 Drawing Sheets

METHOD FOR MONITORING HYDROCARBON SLIP FROM AN OXIDATION CATALYST

TECHNICAL FIELD

This disclosure is related to monitoring exhaust gas constituents in exhaust aftertreatment systems of internal combustion engines.

BACKGROUND

The statements in this section merely provide background information related to the present disclosure. Accordingly, such statements are not intended to constitute an admission of prior art.

Known compression-ignition internal combustion engines are equipped with exhaust aftertreatment systems including oxidation catalysts and catalyzed particulate filters to treat an exhaust gas feedstream. Catalyzed particulate filters require periodic regeneration, which may include using a high-temperature exhaust gas feedstream to burn trapped particulate matter. In operation, a high-temperature exhaust gas feedstream may be generated by oxidizing hydrocarbons in the oxidation catalyst. Breakthrough of hydrocarbons from the oxidation catalyst into the catalyzed particulate filter may cause excess regeneration and associated temperature rise therein. It is known that excessive regeneration and associated temperature rise may cause a fault in the catalyzed particulate filter.

SUMMARY

A method for operating a compression-ignition internal combustion engine including an exhaust aftertreatment system having an oxidation catalyst fluidly coupled upstream of a catalyzed particulate filter includes introducing fuel into an exhaust gas feedstream of the engine upstream of the oxidation catalyst, determining operating parameters associated with the exhaust gas feedstream, determining a hydrocarbon slip rate through the oxidation catalyst corresponding to the operating parameters associated with the exhaust gas feedstream and the introduced fuel into the exhaust gas feedstream, and controlling a flowrate of fuel introduced into the exhaust gas feedstream upstream of the oxidation catalyst in response to the estimated hydrocarbon slip rate through the oxidation catalyst.

BRIEF DESCRIPTION OF THE DRAWINGS

One or more embodiments will now be described, by way of example, with reference to the accompanying drawings, in which.

DETAILED DESCRIPTION

Figure 1:
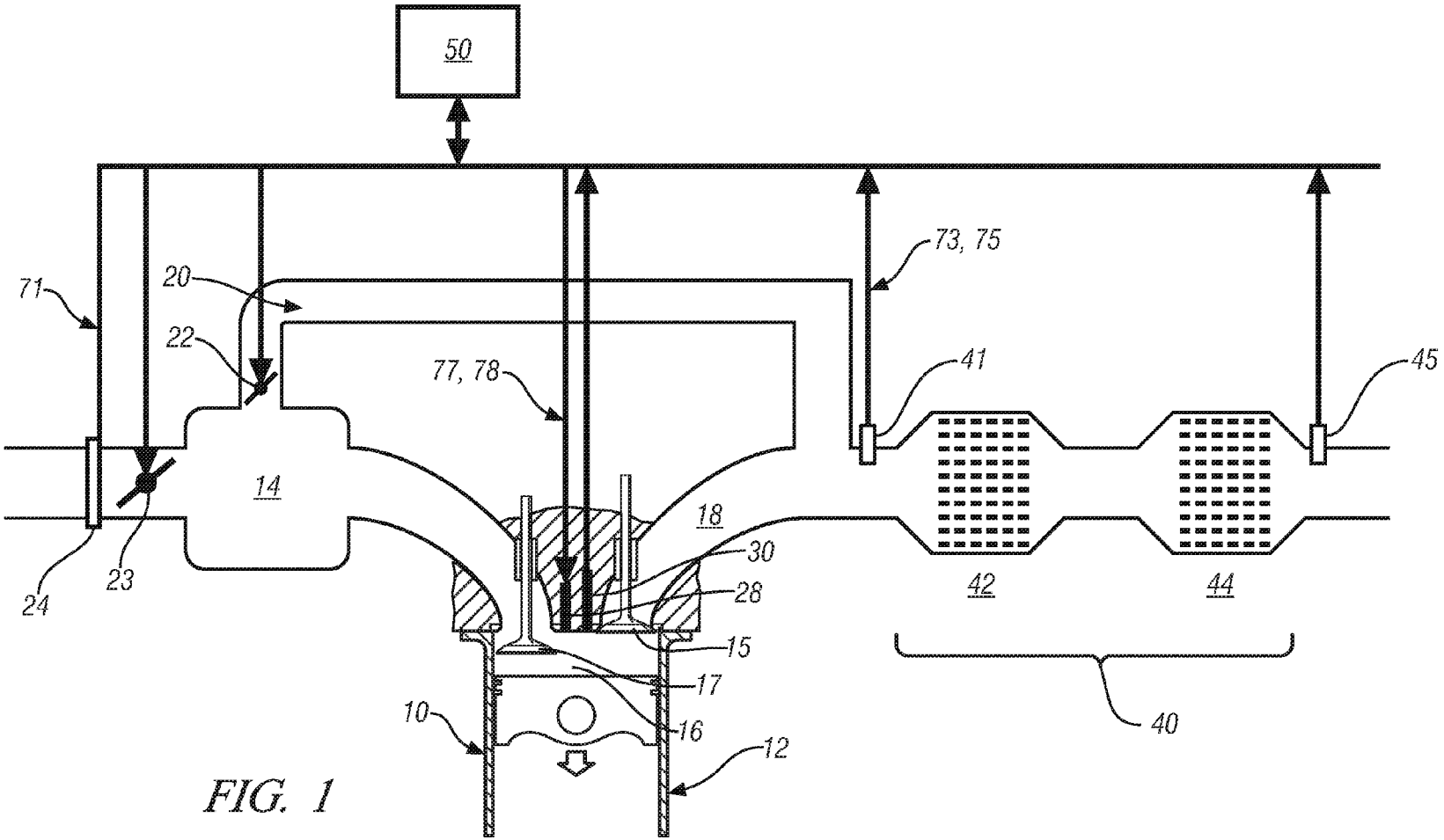
FIG. 1 illustrates a portion of a single cylinder of a compression-ignition internal combustion engine in accordance with the disclosure.

Referring now to the drawings, wherein the showings are for the purpose of illustrating certain exemplary embodiments only and not for the purpose of limiting the same, FIG. 1 schematically illustrates a portion of a single cylinder 12 of a compression-ignition internal combustion engine 10. The internal combustion engine 10 is configured to operate in a four-stroke combustion cycle including repetitively executed intake-compression-ignition-exhaust strokes, or any other suitable combustion cycle. The internal combustion engine 10 preferably includes an intake manifold 14, combustion chamber 16, intake and exhaust valves 17 and 15, respectively, an exhaust manifold 18, and an EGR system 20 including an EGR valve 22. The intake manifold 14 preferably includes a mass airflow sensing device 24 that generates engine mass airflow signal 71. The intake manifold 14 optionally includes a throttle device 23 in one embodiment. An air/fuel ratio sensing device 41 is configured to monitor an exhaust gas feedstream of the internal combustion engine 10, and preferably generates signal outputs including an air/fuel ratio signal 75 and an exhaust gas feedstream temperature signal 73. A fuel injector 28 is configured to directly inject a fuel pulse into the combustion chamber 16 in response to a pulsewidth command, e.g., first and second pulsewidth commands 77 and 78, respectively, described herein. In one embodiment, one or more pressure sensor(s) 30 is configured to monitor in-cylinder pressure in one, or preferably all, of the plurality of cylinders of the engine 10 during each combustion cycle. The single cylinder 12 is depicted, but it is appreciated that the engine 10 includes a plurality of cylinders each having an associated combustion chamber 16, fuel injector 28, and intake and exhaust valves 17 and 15. The description of the engine 10 is illustrative, and the concepts described herein are not limited thereto.

The exhaust manifold 18 channels the exhaust gas feedstream of the internal combustion engine 10 to a fluidly coupled exhaust aftertreatment system 40. The exhaust aftertreatment system 40 includes an oxidation catalyst 42 fluidly coupled to and upstream of a diesel particulate filter 44. The oxidation catalyst 42 includes a ceramic or metallic substrate element that is coated with one or more catalytically active materials. The diesel particulate filter 44 includes a ceramic filter element that is preferably coated with catalytically active materials. In one embodiment there is another sensing device 45 located downstream of the diesel particulate filter 44 for monitoring the exhaust gas feedstream thereat for control and diagnostic purposes.

A control module 50 is signally connected to the air/fuel ratio sensing device 41, the mass airflow sensing device 24, and the pressure sensor(s) 30. The control module 50 is configured to execute control schemes to control operation of the engine 10 to form the cylinder charge in response to an operator command.

Control module, module, controller, control unit, processor and similar terms mean any suitable one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs, combinatorial logic circuit(s), input/output circuit(s) and devices, appropriate signal conditioning and buffer circuitry, and other suitable components to provide the described functionality. The control module has a set of control algorithms, including resident software program instructions and calibrations stored in memory and executed to provide the desired functions. The algorithms are preferably executed during preset loop cycles. Algorithms are executed, such as by a central processing unit, to monitor inputs from sensing devices and other networked control modules, and execute control and diagnostic routines to control operation of actuators. Loop cycles may be executed at regular intervals, for example each 3.125, 6.25, 12.5, 25 and 100 milliseconds during ongoing engine and vehicle operation. Alternatively, algorithms may be executed in response to occurrence of an event.

The control module 50 is operatively connected to the fuel injector 28. The control module 50 commands pulsewidths to cause the fuel injector 28 to deliver fuel pulses to the combustion chamber 16. The commanded pulsewidth is an elapsed time period during which the fuel injector 28 is commanded open to deliver the fuel pulse. The commanded pulsewidth is combined with a fuel density to achieve an injected fuel mass for a cylinder charge. The control module 50 commands the first pulsewidth 77 to cause the fuel injector 28 to deliver a first fuel pulse to the combustion chamber 16 to interact with intake air and any internally retained and externally recirculated exhaust gases to form a cylinder charge in response an operator torque request. In one embodiment, the control module 50 commands the second pulsewidth 78 to cause the fuel injector 28 to deliver a second fuel pulse to the combustion chamber 16, as described hereinbelow.

The control module 50 is operatively connected to the EGR valve 22 to command an EGR flowrate to achieve a preferred EGR fraction in the cylinder charge. It is appreciated that age, calibration, contamination and other factors may affect operation of the EGR system 20, thus causing variations in in-cylinder air/fuel ratio of the cylinder charge. The control module 50 is operatively connected to the throttle device 23 to command a preferred fresh air mass flowrate for the cylinder charge. In one embodiment, the control module 50 is operatively connected to a turbocharger device to command a preferred boost pressure associated with the cylinder charge.

In operation, there is a need to periodically purge particulate matter trapped by the diesel particulate filter 44. One exemplary method for purging the diesel particulate filter 44 includes introducing fuel into the exhaust gas feedstream upstream of the oxidation catalyst 42. The introduced fuel oxidized in the oxidation catalyst 42 causes the temperature of the exhaust gas feedstream to increase, thus increasing the temperature of the diesel particulate filter 44 and burning the trapped particulate matter. In one embodiment, fuel is introduced into the exhaust gas feedstream upstream of the oxidation catalyst 42 using a process referred to as post-injection fueling. In post-injection fueling, control module 50 commands the fuel injector 28 to inject the second fuel pulse into the combustion chamber 16 in response to the second pulsewidth command 78 subsequent to a completed combustion stroke when the exhaust valve 15 opened. The injected raw fuel of the second fuel pulse passes into the exhaust gas feedstream in an unburned state, and is preferably oxidized in the oxidation catalyst 42. It is appreciated that there are other suitable methods for introducing unburned fuel into the exhaust gas feedstream to effect purge of particulate matter from the diesel particulate filter 44. One other suitable method for introducing unburned fuel into the exhaust gas feedstream includes equipping the exhaust system with a controllable dosing device to introduce raw fuel into the exhaust gas feedstream upstream of the oxidation catalyst 42.

Figure 2:
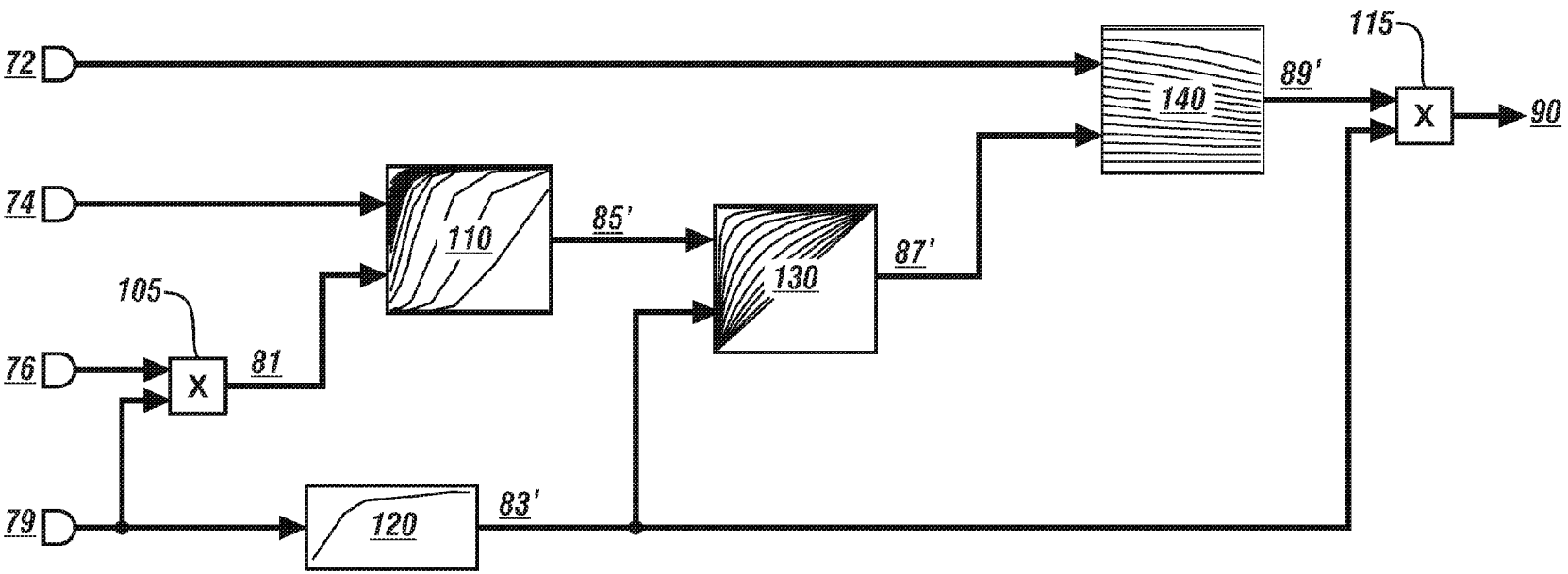
FIG. 2 illustrates a control algorithm for determining an effective hydrocarbon oxidation efficiency of an oxidation catalyst in accordance with the disclosure.

FIG. 2 schematically shows a control algorithm 100 that is preferably executed in the control module 50 for determining an effective hydrocarbon oxidation efficiency (90) of the oxidation catalyst 42 using a kinetics-based estimation scheme. The effective hydrocarbon oxidation efficiency (90) of the oxidation catalyst 42 is used to determine a hydrocarbon slip rate for the oxidation catalyst 42, which may be used for engine control purposes. A plurality of signal and control parameters for the internal combustion engine 10, the exhaust aftertreatment system 40, and the exhaust gas feedstream are used to determine input parameters for the executable algorithm 100.

The executable algorithm 100 processes the input parameters using a plurality of predetermined calibrations 110, 120, 130, and 140 and arithmetic operations 105 and 115 to calculate the effective hydrocarbon oxidation efficiency (90) for the oxidation catalyst 42.

The plurality of signal and control parameters include the engine mass airflow signal 71, which is preferably measured using the mass airflow sensor 24, the second pulsewidth command 78 to inject the second fuel pulse, for a single one or a plurality of the fuel injectors 28, the exhaust gas feedstream temperature signal 73, preferably output from the air/fuel ratio sensor 41 or another suitable temperature sensing device; and the air/fuel ratio signal 75 output from the air/fuel ratio sensing device 41.

The input parameters for the executable algorithm 100 include a hydrocarbon/oxygen ratio 72 in the exhaust gas feedstream, which is determined as a ratio of hydrocarbon concentration and the oxygen concentration 76 in the exhaust gas feedstream. The hydrocarbon concentration in the exhaust gas feedstream is preferably determined based on fuel mass delivered to the internal combustion engine 10 corresponding to the second pulsewidth command 78 and the engine mass airflow signal 71. The oxygen concentration 76 in the exhaust gas feedstream is preferably determined using the air/fuel ratio signal 75 output from the air/fuel ratio sensing device 41 and the engine mass airflow signal 71.

The input parameters for the executable algorithm 100 include the temperature 74 of the oxidation catalyst 42, which is calculated or otherwise determined using the exhaust gas feedstream temperature signal 73.

The input parameters for the executable algorithm 100 include the oxygen concentration 76, preferably determined using the air/fuel ratio signal 75 output from the air/fuel ratio sensing device 41 and a resident time 79. The resident time 79 is a term that describes an elapsed period of time that a unit of exhaust gas resides in the oxidation catalyst 42, and is calculated as a function of the engine mass airflow signal 71 and a displaced volume of the oxidation catalyst 42. It is appreciated that the engine mass airflow signal 71 is converted to a volumetric flowrate to calculate the resident time 79.

Each of the predetermined calibrations 110, 130, and 140 preferably includes a two-dimensional data array containing a plurality of parameters that correlate to the associated input parameters. The predetermined calibration 120 includes a one-dimensional data array containing plurality or parameters that correlate to the input parameter. The parameters for each of the aforementioned calibrations 110, 120, 130 and 140 are preferably developed off-line for a specific embodiment of the oxidation catalyst 42 using experimental equipment and setups. It is appreciated that the predetermined calibrations 110, 120, 130, and 140 may be arranged, compiled, and executed in any suitable form within the control module 50, including, e.g., data arrays, executable equations, and application-specific integrated circuits.

Figure 3:
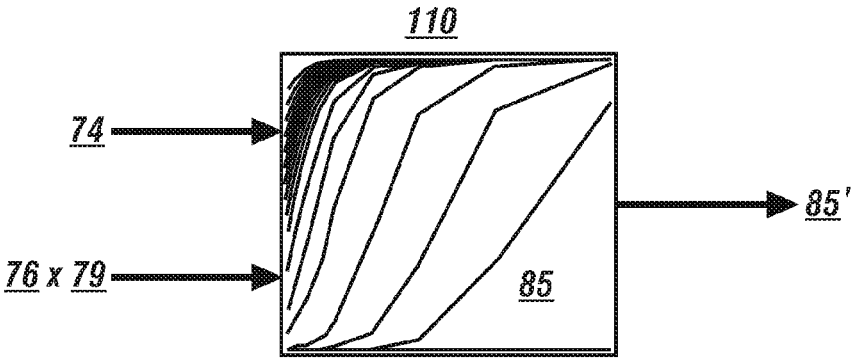
FIG. 3 illustrates a plurality of selectable base hydrocarbon oxidation efficiencies for an oxidation catalyst corresponding to a range input parameters of the temperature of the oxidation catalyst and a range of states for a combination of the oxygen concentration in the exhaust gas feedstream and a range of resident times in accordance with the disclosure.

FIG. 3 shows calibration 110 depicted in graphical form. Calibration 110 includes a plurality of base hydrocarbon oxidation efficiencies for the oxidation catalyst 42 (85) plotted in relation to a range for the temperature of the oxidation catalyst 42 74 and a range for the combination of the oxygen concentration 76 and the resident time 79. An output of the calibration 110 is a selected one of the base hydrocarbon oxidation efficiencies for the oxidation catalyst 42 (85') that corresponds to a present temperature of the oxidation catalyst 42 (74), a present oxygen concentration (76), and a present resident time (79).

Figure 4:
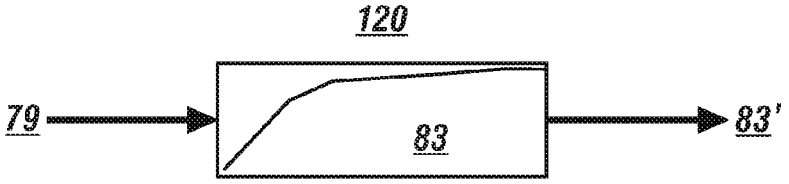
FIG. 4 illustrates a plurality of selectable base diffusion efficiencies for an oxidation catalyst that correspond to a range of resident times in accordance with the disclosure.

FIG. 4 shows calibration 120 depicted in graphical form. Calibration 120 includes a plurality of base diffusion efficiencies for the oxidation catalyst 42 (83) plotted in relation to the resident time 79. An output of the calibration 120 is a selected one of the base diffusion efficiencies (83') that corresponds to a present resident time 79.

Figure 5:
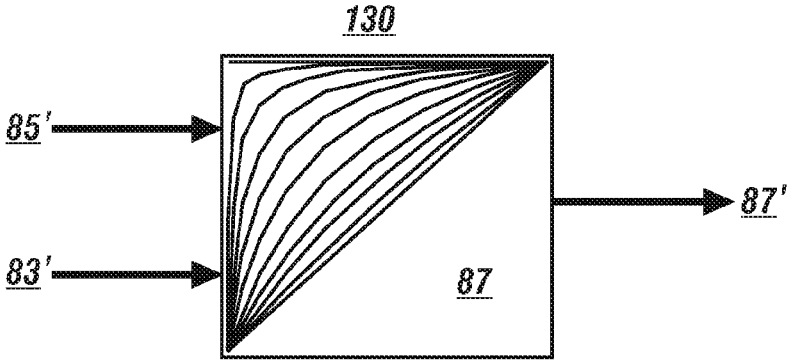
FIG. 5 illustrates a plurality of selectable diffusion-adjusted hydrocarbon oxidation efficiencies for an oxidation catalyst that correspond to a range of base diffusion efficiencies and a range of base hydrocarbon oxidation efficiencies in accordance with the disclosure.

FIG. 5 shows calibration 130 depicted in graphical form. Calibration 130 includes a plurality of diffusion-adjusted hydrocarbon efficiencies for the oxidation catalyst 42 (87), plotted in relation to a range of base hydrocarbon oxidation efficiencies for the oxidation catalyst 42 (85) and a range of the base diffusion efficiencies (83). An output of the calibration 130 is a selected one of the diffusion-adjusted hydrocarbon oxidation efficiencies for the oxidation catalyst 42 (87') corresponding to the selected one of the base diffusion efficiencies 83' and the selected one of the base hydrocarbon oxidation efficiencies for the oxidation catalyst 42 85'.

Figure 6:
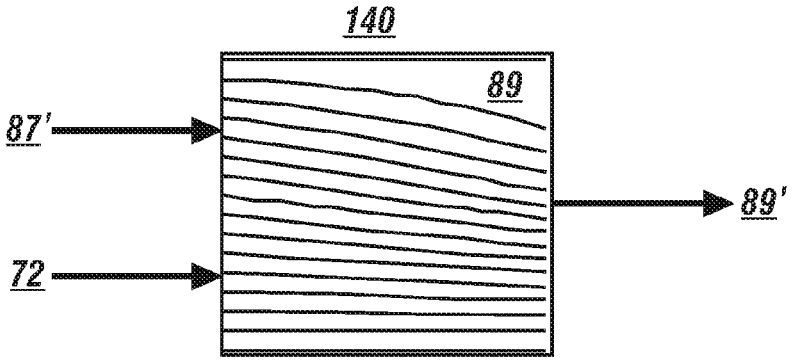
FIG. 6 illustrates a plurality of selectable diffusion-adjusted hydrocarbon oxidation efficiencies further adjusted for a hydrocarbon/oxygen ratio in an exhaust gas feedstream that correspond to a range of diffusion-adjusted hydrocarbon oxidation efficiencies and a range of hydrocarbon/oxygen ratios in the exhaust gas feedstream in accordance with the disclosure.

FIG. 6 shows calibration 140 depicted in graphical form. Calibration 140 includes a plurality of diffusion-adjusted hydrocarbon oxidation efficiencies adjusted for a hydrocarbon/oxygen ratio in the exhaust gas feedstream (89) plotted in relation to a range of diffusion-adjusted hydrocarbon oxidation efficiencies in the oxidation catalyst 42 and a range of hydrocarbon/oxygen ratios 72 in the exhaust gas feedstream. An output of the calibration 140 is a selected one of the diffusion-adjusted hydrocarbon oxidation efficiencies adjusted for the hydrocarbon/oxygen ratio in the exhaust gas feedstream (89') corresponding to the selected one of the diffusion-adjusted hydrocarbon oxidation efficiencies in the oxidation catalyst 42 and the present hydrocarbon/oxygen ratio 72 in the exhaust gas feedstream.

The control algorithm 100 is preferably executed in the control module 50 to calculate the effective hydrocarbon oxidation efficiency 90 for the oxidation catalyst 42. The plurality of signal and control parameters for the internal combustion engine 10 are monitored, including the engine mass airflow 71, the second pulsewidth command 78 to inject the second fuel pulse, the exhaust gas feedstream temperature 73, and the air/fuel ratio 75. The input parameters including the hydrocarbon/oxygen ratio in the exhaust gas feedstream 72, the temperature 74 of the oxidation catalyst 42, the oxygen concentration 76 in the exhaust gas feedstream, and the resident time 79 are determined therefrom.

Arithmetic operation 105, which is preferably a multiplication operation, is used to determine a present state 81 for the combination of the oxygen concentration 76 and the resident time 79.

The present state 81 for the combination of the oxygen concentration 76 and the resident time 79 and the temperature 74 of the oxidation catalyst 42 are used as inputs to calibration 110 to select the corresponding present base hydrocarbon oxidation efficiency (85') therefrom.

The resident time 79 is used to select the corresponding present base diffusion efficiency (83') for the oxidation catalyst 42 using calibration 120.

The present base diffusion efficiency (83') and the present base hydrocarbon oxidation efficiency (85') are used to select the corresponding present diffusion-adjusted hydrocarbon oxidation efficiency (87') using calibration 130.

The present diffusion-adjusted hydrocarbon oxidation efficiency (87') and the hydrocarbon/oxygen ratio in the exhaust gas feedstream 72 are used to select the corresponding present diffusion-adjusted hydrocarbon oxidation efficiency adjusted for hydrocarbon/oxygen ratio in the exhaust gas feedstream (89') using calibration 140.

Arithmetic operation 115, which is preferably a multiplication operation, is used to combine the diffusion-adjusted hydrocarbon oxidation efficiency adjusted for hydrocarbon/oxygen ratio in the exhaust gas feedstream (89') and the present base diffusion efficiency (83') to calculate the present effective hydrocarbon oxidation efficiency 90 for the oxidation catalyst 42.

The present effective hydrocarbon oxidation efficiency 90 for the oxidation catalyst 42 may be used to calculate a hydrocarbon slip rate through the oxidation catalyst 42, as follows:

$$HC_{DOC_SLIP}=HC_{DOC_INLET}(1-\eta_{DOC}) \quad [1]$$

wherein $\eta_{DOC}$ is the present effective hydrocarbon oxidation efficiency 90 for the oxidation catalyst 42, $HC_{DOC_SLIP}$ is the hydrocarbon slip rate, and $HC_{DOC_INLET}$ is the hydrocarbon concentration in the exhaust gas feedstream upstream of the oxidation catalyst 42.

The control module 50 estimates the hydrocarbon slip rate $HC_{DOC_SLIP}$ as described hereinabove during a period when it is purging trapped particulate matter from the diesel particulate filter 44 by introducing a flowrate of fuel into the exhaust gas feedstream upstream of the oxidation catalyst 42 that is intended to be oxidized in the oxidation catalyst 42. If a portion of the fuel introduced into the exhaust gas feedstream is not oxidized in the oxidation catalyst 42, it may oxidize in the diesel particulate filter 44, causing temperature in the diesel particulate filter 44 to exceed a preferred temperature associated with the regeneration process.

Preferably, the control module 50 includes a closed-loop control scheme that adjusts the magnitude of the second pulsewidth 78 for the fuel injector 28 to deliver the second fuel pulse to the combustion chamber 16 and thus adjust the fuel introduced into the exhaust gas feedstream in response to the estimated hydrocarbon slip rate $HC_{DOC_SLIP}$. The magnitude of the second pulsewidth 78 for the fuel injector 28 is adjusted to control the estimated hydrocarbon slip rate $HC_{DOC_SLIP}$ and thus control the regeneration temperature of the diesel particulate filter 44.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method for operating a compression-ignition internal combustion engine including an exhaust aftertreatment system comprising an oxidation catalyst fluidly coupled upstream of a catalyzed particulate filter, the method comprising:

introducing fuel into an exhaust gas feedstream of the engine upstream of the oxidation catalyst;

determining operating parameters associated with the exhaust gas feedstream;

determining a hydrocarbon slip rate through the oxidation catalyst corresponding to the operating parameters associated with the exhaust gas feedstream and the introduced fuel into the exhaust gas feedstream, comprising determining an effective hydrocarbon oxidation efficiency through the oxidation catalyst corresponding to the operating parameters associated with the exhaust gas feedstream and the flowrate of fuel introduced into the exhaust gas feedstream and determining the hydrocarbon slip rate through the oxidation catalyst corresponding to the effective hydrocarbon oxidation efficiency; and controlling a flowrate of fuel introduced into the exhaust gas feedstream upstream of the oxidation catalyst in response to the estimated hydrocarbon slip rate through the oxidation catalyst;

wherein determining the effective hydrocarbon oxidation efficiency through the oxidation catalyst corresponding to the operating parameters associated with the exhaust gas feedstream and the introduced fuel into the exhaust gas feedstream comprises:

determining a present base hydrocarbon oxidation efficiency for the oxidation catalyst corresponding to a temperature of the oxidation catalyst, an oxygen concentration in the exhaust gas feedstream, and an exhaust gas resident time in the oxidation catalyst;

determining a diffusion-adjusted hydrocarbon oxidation efficiency for the oxidation catalyst corresponding to the present base hydrocarbon oxidation efficiency and a present base diffusion efficiency for the oxidation catalyst;

determining a diffusion-adjusted hydrocarbon oxidation efficiency for the oxidation catalyst adjusted for a hydrocarbon/oxygen ratio in the exhaust gas feedstream; and combining the diffusion-adjusted hydrocarbon oxidation efficiency for the oxidation catalyst adjusted for a hydrocarbon/oxygen ratio in the exhaust gas feedstream with the present base diffusion efficiency to calculate the present effective hydrocarbon oxidation efficiency through the oxidation catalyst.

2. The method of claim 1, wherein determining the operating parameters associated with the exhaust gas feedstream comprises:

monitoring oxygen concentration in the exhaust gas feedstream using an air/fuel ratio sensor;

monitoring engine mass airflow;

monitoring a temperature of the oxidation catalyst; and monitoring an exhaust gas resident time in the oxidation catalyst.

3. The method of claim 1, comprising determining the base diffusion efficiency for the oxidation catalyst corresponding to the exhaust gas resident time in the oxidation catalyst.

4. The method of claim 1, wherein determining the present base hydrocarbon oxidation efficiency for the oxidation catalyst corresponding to the temperature of the oxidation catalyst, the oxygen concentration in the exhaust gas feedstream, and the exhaust gas resident time in the oxidation catalyst comprises selecting the present base hydrocarbon oxidation efficiency from a predetermined two-dimensional data array containing a plurality of base hydrocarbon oxidation efficiencies for the oxidation catalyst that correlate to input parameters comprising the temperature of the oxidation catalyst and the oxygen concentration in the exhaust gas feedstream multiplied by the exhaust gas resident time in the oxidation catalyst.

5. The method of claim 1, wherein determining the diffusion-adjusted hydrocarbon oxidation efficiency for the oxidation catalyst comprises selecting the diffusion-adjusted hydrocarbon oxidation efficiency for the oxidation catalyst from a predetermined two-dimensional data array containing a plurality of diffusion-adjusted hydrocarbon oxidation efficiencies for the oxidation catalyst that correlate to input parameters comprising the present base hydrocarbon oxidation efficiency for the oxidation catalyst and the base diffusion efficiency for the oxidation catalyst.

6. The method of claim 1, wherein determining the diffusion-adjusted hydrocarbon oxidation efficiency for the oxidation catalyst adjusted for the hydrocarbon/oxygen ratio in the exhaust gas feedstream comprises:

determining a hydrocarbon/oxygen ratio in the exhaust gas feedstream; and selecting the diffusion-adjusted hydrocarbon oxidation efficiency for the oxidation catalyst adjusted for the hydrocarbon/oxygen ratio in the exhaust gas feedstream from a predetermined two-dimensional data array containing a plurality of diffusion-adjusted hydrocarbon oxidation efficiencies for the oxidation catalyst adjusted for the hydrocarbon/oxygen ratio in the exhaust gas feedstream that correlate to input parameters comprising the diffusion-adjusted hydrocarbon oxidation efficiency for the oxidation catalyst and the hydrocarbon/oxygen ratio in the exhaust gas feedstream.

7. The method of claim 1, wherein controlling the flowrate of fuel introduced into the exhaust gas feedstream upstream of the oxidation catalyst comprises commanding a fuel injector to deliver a fuel pulse to a combustion chamber of the engine subsequent to a completed combustion stroke and when a corresponding exhaust valve is opened.

8. Method for operating a compression-ignition internal combustion engine to regenerate a catalyzed particulate filter, the method comprising:

introducing fuel into an exhaust gas feedstream upstream of an oxidation catalyst upstream of a catalyzed particulate filter;

determining a hydrocarbon/oxygen ratio in the exhaust gas feedstream upstream of the oxidation catalyst, a temperature of the oxidation catalyst, an oxygen concentration in the exhaust gas feedstream, and an exhaust gas resident time in the oxidation catalyst;

determining a base hydrocarbon oxidation efficiency for the oxidation catalyst corresponding to the temperature of the oxidation catalyst, the oxygen concentration in the exhaust gas feedstream, and the exhaust gas resident time in the oxidation catalyst;

determining an effective hydrocarbon oxidation efficiency for the oxidation catalyst by adjusting the base hydrocarbon oxidation efficiency for the oxidation catalyst in response to a present diffusion efficiency in the oxidation catalyst and the hydrocarbon/oxygen ratio in the exhaust gas feedstream upstream of the oxidation catalyst, comprising determining a diffusion-adjusted hydrocarbon oxidation efficiency for the oxidation catalyst, determining a diffusion-adjusted hydrocarbon oxidation efficiency for the oxidation catalyst adjusted for the hydrocarbon/oxygen ratio in the exhaust gas feedstream, and determining the effective hydrocarbon oxidation efficiency through the oxidation catalyst by combining the diffusion-adjusted hydrocarbon oxidation efficiency for the oxidation catalyst adjusted for a hydrocarbon/oxygen ratio in the exhaust gas feedstream with the present base diffusion efficiency;

calculating a hydrocarbon slip rate through the oxidation catalyst corresponding to the effective hydrocarbon oxidation conversion efficiency for the oxidation catalyst and a hydrocarbon concentration in the exhaust gas feedstream upstream of the oxidation catalyst; and controlling the introduced fuel into the exhaust gas feedstream upstream of the oxidation catalyst in response to the estimated hydrocarbon slip rate through the oxidation catalyst.

9. The method of claim 8, wherein determining the base hydrocarbon oxidation efficiency for the oxidation catalyst corresponding to the temperature of the oxidation catalyst, the oxygen concentration in the exhaust gas feedstream, and the exhaust gas resident time in the oxidation catalyst comprises selecting the present base hydrocarbon oxidation efficiency from a predetermined two-dimensional data array containing a plurality of base hydrocarbon oxidation efficiencies for the oxidation catalyst that correlate to input parameters comprising the temperature of the oxidation catalyst and the oxygen concentration in the exhaust gas feedstream multiplied by the exhaust gas resident time in the oxidation catalyst.

10. The method of claim 8, wherein determining the diffusion-adjusted hydrocarbon oxidation efficiency for the oxidation catalyst comprises selecting the diffusion-adjusted hydrocarbon oxidation efficiency for the oxidation catalyst from a predetermined two-dimensional data array containing a plurality of diffusion-adjusted hydrocarbon oxidation efficiencies for the oxidation catalyst that correlate to input parameters comprising the present base hydrocarbon oxidation efficiency for the oxidation catalyst and the base diffusion efficiency for the oxidation catalyst.

11. The method of claim 8, wherein determining the diffusion-adjusted hydrocarbon oxidation efficiency for the oxidation catalyst adjusted for the hydrocarbon/oxygen ratio in the exhaust gas feedstream comprises:

determining a hydrocarbon/oxygen ratio in the exhaust gas feedstream; and selecting the diffusion-adjusted hydrocarbon oxidation efficiency for the oxidation catalyst adjusted for the hydrocarbon/oxygen ratio in the exhaust gas feedstream from a predetermined two-dimensional data array containing a plurality of diffusion-adjusted hydrocarbon oxidation efficiencies for the oxidation catalyst adjusted for the hydrocarbon/oxygen ratio in the exhaust gas feedstream that correlate to input parameters comprising the diffusion-adjusted hydrocarbon oxidation efficiency for the oxidation catalyst and the hydrocarbon/oxygen ratio in the exhaust gas feedstream.

* * * * *